US006223504B1

(12) United States Patent
Minor et al.

(10) Patent No.: US 6,223,504 B1
(45) **Date of Patent: *May 1, 2001**

(54) PACKAGE WITH BASE PLATE

(75) Inventors: Dale E. Minor; Douglas H. Sudhoff, both of Madison, IN (US)

(73) Assignee: Reliance Electric Technologies, LLC, Thousand Oaks, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,224

(22) Filed: May 19, 1998

(51) Int. Cl.[7] ..... B65B 53/00
(52) U.S. Cl. ..... 53/441; 53/472; 493/136
(58) Field of Search ..... 493/136, 137, 493/139; 53/457, 458, 472, 473, 476, 463, 449, 441; 229/103.2, 198.2, 148, 149

(56) References Cited

U.S. PATENT DOCUMENTS

| | | | | |
|---|---|---|---|---|
| 2,285,991 | * | 6/1942 | Lester | 229/103.2 |
| 2,398,797 | * | 4/1946 | Meyer et al. | 229/198.2 |
| 4,895,296 | * | 1/1990 | Trauschke | 229/198.2 |
| 5,009,059 | * | 4/1991 | Cocciadiferro et al. | 53/472 |
| 5,472,138 | * | 12/1995 | Ingram | 229/198.2 |
| 5,542,536 | * | 8/1996 | Sutherland | 206/140 |
| 5,662,508 | * | 9/1997 | Smith | 493/137 |
| 5,704,542 | * | 1/1998 | Harrelson | 229/198.2 |
| 5,759,146 | * | 6/1998 | Wilkinson | 53/441 |

* cited by examiner

*Primary Examiner*—Eugene Kim
(74) *Attorney, Agent, or Firm*—Daniel G. Radler; A. M. Gerasimow

(57) ABSTRACT

A base plate for a package to inhibit an object's inadvertent displacement when the plate and object are positioned within a shipping container. The plate is composed of a rectangular sheet of paperboard or sheet form material folded at least once, and preferably twice, both horizontally and vertically to form multiple sheets in superimposed, overlapping relation thereby creating a support or base plate. A longitudinally extending separation in the upper of the sheet form supports include a plurality of separations extending from opposite edges of the longitudinal separation to form cantilevered tabs extending from opposite sides of the separation. A recess in the lower sheet form support underlying the longitudinally extending separation permits deflection of the tabs into the recess when an object, such as a motor, is placed thereon to thereby partially capture, cradle and cushion the object upon the support plate. The package is formed by shrink wrapping the motor and the base plate and placing the same into a shipping container.

12 Claims, 7 Drawing Sheets

FIG. 7
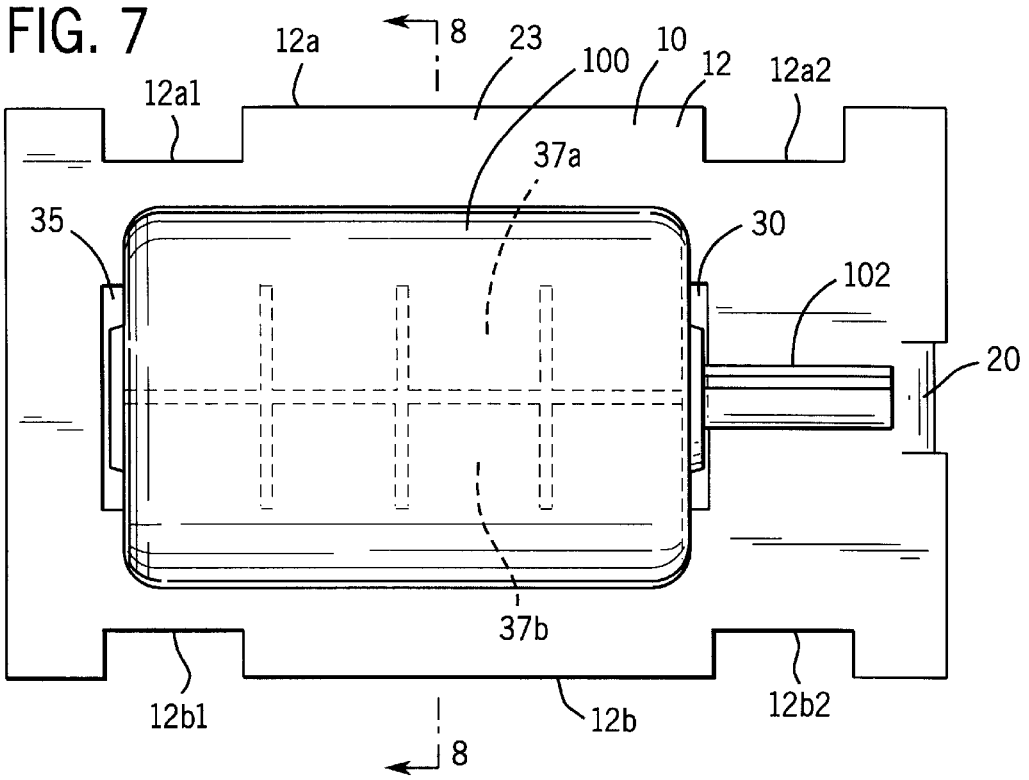
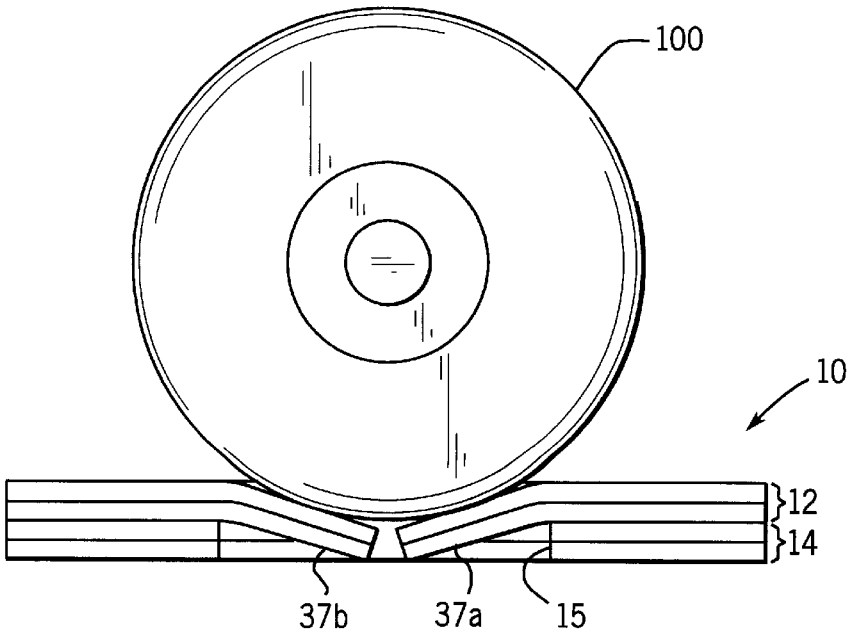
FIG. 8

FIG. 9
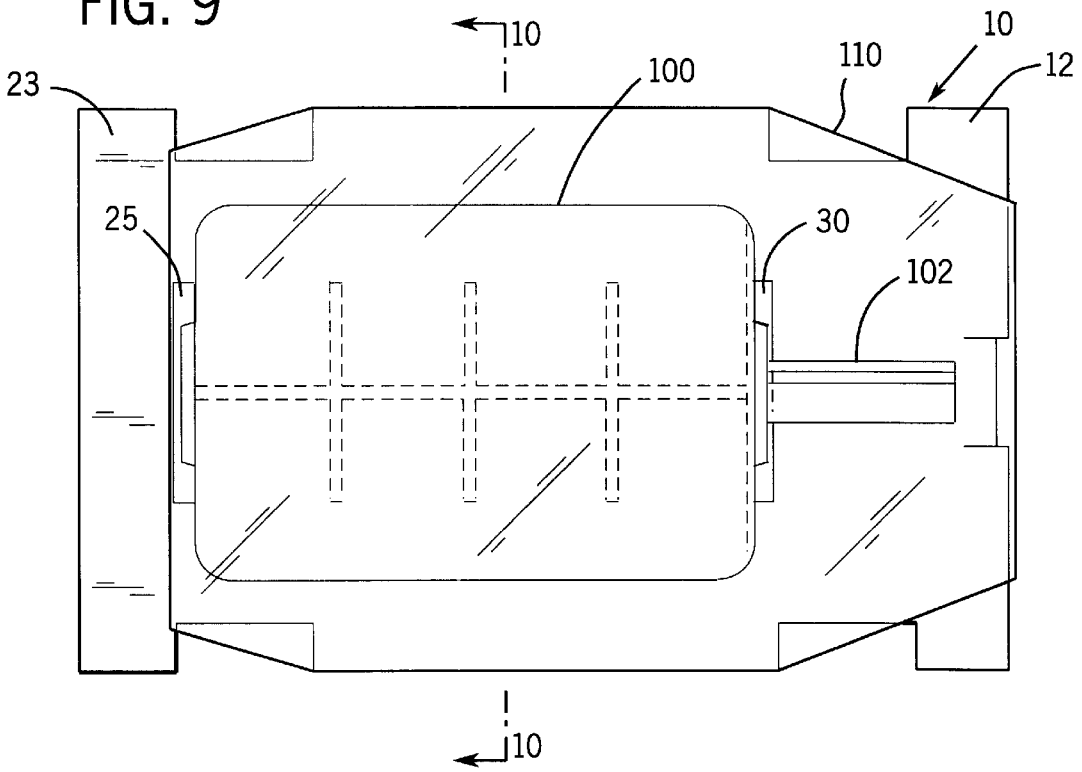
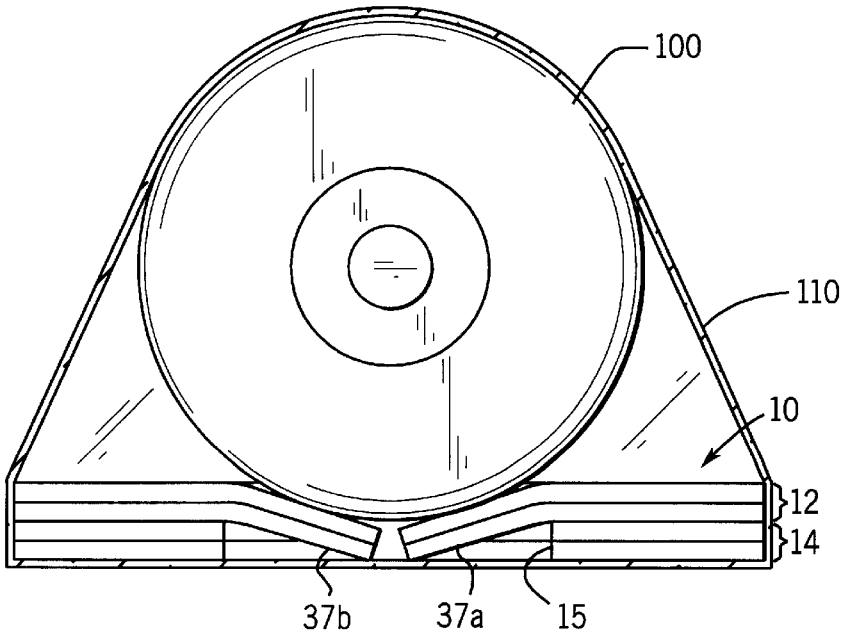
FIG. 10

PACKAGE WITH BASE PLATE

BACKGROUND OF THE INVENTION

The present invention relates generally to packaging for heavy objects, and more particularly relates to a packaging base plate for heavy objects such as motors.

Current motor packaging base plates employed by the industry for shipping electric motors of varying sizes, usually employ a base plate and cradle including two or more pieces, (more often than not more than one cradle is necessary to support the motor in shipment) while foot mounted motors employ wafer board base plates without a cradle. More often, these multi-piece packages employ a shrink or stretch wrap which attempts to hold the motor position relative to the base plate. In either of these prior art systems, the motors tend to slide on the hard base plate as the shrink or stretch wrap memory changes which can abrade the finish on the heavy object, e.g., the motor. The use of styrofoam formed cradles is expensive since multiple cradles are often employed. Moreover, with three materials in the packaging, wood, cardboard and plastic, the recycling of materials becomes more difficult rather than less. Additionally, the current two piece design requires additional labor in packaging the motor because of the handling of separate and multiple pieces.

The use of two or more ply cardboard for a pallet for the shipment of heavy objects, for example compressors and the like, is old in the art. For example, some of the base pads for heavy objects are provided with depressions to accommodate the object's support feet. In other prior art, bottom sheets of pallet shipping structures of several layers of card stock are formed in which one or more is cut out so as to positively locate the heavy objects, such as compressors. In other prior art, a top sheet of single faced corrugated card stock is embossed with the outline of the article that is to be shipped. The card support and the products are shipped covered with a shrink wrap material that holds the contents in position. Moreover, the use of a foam-like material, for example, a foam such as styrofoam or the like has been employed successfully to form a conforming surface for the article being shipped. However, none of the prior art provides a novel base plate structure for receiving, cradling, cushioning and inhibiting movement of a heavy object thereon, which base plate is constructed of inexpensive material while minimizing labor costs in forming a package to be placed in a shipping container for shipment. Moreover, the inexpensive use of a single material for the packaging base plate as well as its novel structure allows for easy recycling of the materials without undue expense.

SUMMARY OF THE INVENTION

The present invention meets the advantages of ease of construction, simplicity in design, ease of handling and low expense by providing a package for heavier objects, such as electric motors and the like including a novel support plate which inhibits the object, such as the motor, from inadvertent displacement when the plate and object are positioned within a shipping container. In one embodiment, an upper and lower sheet form is arranged in superimposed, overlapping relation to form a support plate. A plurality of separations is provided in the exposed surface of the upper of the sheet forms to form cantilevered tabs, and a recess is provided in an adjacent or lower sheet form support, underlying at least a portion of the cantilevered tabs, to allow deflection of the tabs into the recess when an object is placed thereon to thereby partially capture, cradle and cushion the object on the upper support plate. In a preferred embodiment, the sheet form comprises paper board such as a double wall cardboard with a corrugated support structure intermediate the walls. Moreover, recesses are provided along at least one longitudinal peripheral edge of the sheet form to facilitate coupling the object and the base plate together as by a retainer, for example a shrink wrap material. The recesses, when employed with a heat shrunk overwrap, inhibit inadvertent displacement of the object relative to the base plate because the wrapped material grips the base plate better than a straight longitudinally extending, single sidewall edge.

In one embodiment of the base plate, where heavier objects such as heavy motors are to be mounted for shipping, a rectangular sheet of paperboard is folded at least once horizontally and once vertically to form, when in folded relationship, four quadrants of paperboard in superimposed, overlapping relation. A longitudinally extending separation in the surface of an exposed quadrant has a length equal to or greater than the portion of the intended object such as a motor to be placed in abutting relation therewith in the package. A plurality of separations extending from opposite sides or edges of the longitudinal separation, in the exposed surface, form a plurality of cantilevered tabs. A recess in a quadrant underlying said longitudinally extended separation permits deflection of at least some of the tabs when the motor is placed thereon, to thereby partially capture, cradle and cushion the object on the plate. Support plate retention means is employed to couple the object and plate together to form a package for placement in a shipping container, such as a crate or box and the like.

The invention also contemplates a method of forming a package for an object to be placed in a shipping container, the package including a base plate for mounting the object thereon and the method of manufacturing a support plate for the object to be packaged. The manufacturing steps including arranging a pair of rectangular sheets of sheet form in superimposed overlapping relation, the sheets being sized larger than the size of the object intended to be supported by the support plate; generating a plurality of cantilevered tabs extending inwardly in the exposed surface of one of the sheets and forming a recess in the sheet on sheet form underlying the cantilevered tabs to permit deflection of at least some of the tabs to conform to the shape of the object when the object is placed thereon to thereby partially couple, cushion and cradle an object on the plate.

Other advantages and a more complete understanding of the invention may be had with reference to the following specification and claims taken in conjunction with the accompanying drawings in which:

DRAWING DESCRIPTION

FIG. 1 is a view in plan illustrating a connected pair of rectangular sheets of sheet form prior to being folded into a support or base plate for lighter objects such as small electric motors and the like;

FIG. 7 is a view in plan of the support plate illustrated in FIGS. 1–3 with a object such as a motor and the like thereon;

FIG. 8 is a fragmentary sectional view taken along line 8—8 of FIG. 7 (not to scale) but to emphasize deflection of the cantilevered tabs constructed in accordance with the present invention;

FIG. 9 is a view in plan of the support plate illustrated in FIGS. 1 through 3 with the motor and support plate being coupled together with a shrink wraplike material;

FIG. 10 is a fragmentary sectional view taken along line 10—10 of FIG. 9, once again not to scale but to emphasize deflection of the cantilevered tabs and constructed in accordance with the present invention;

DESCRIPTION OF THE PREFERRED EMBODIMENTS

Figure 1:
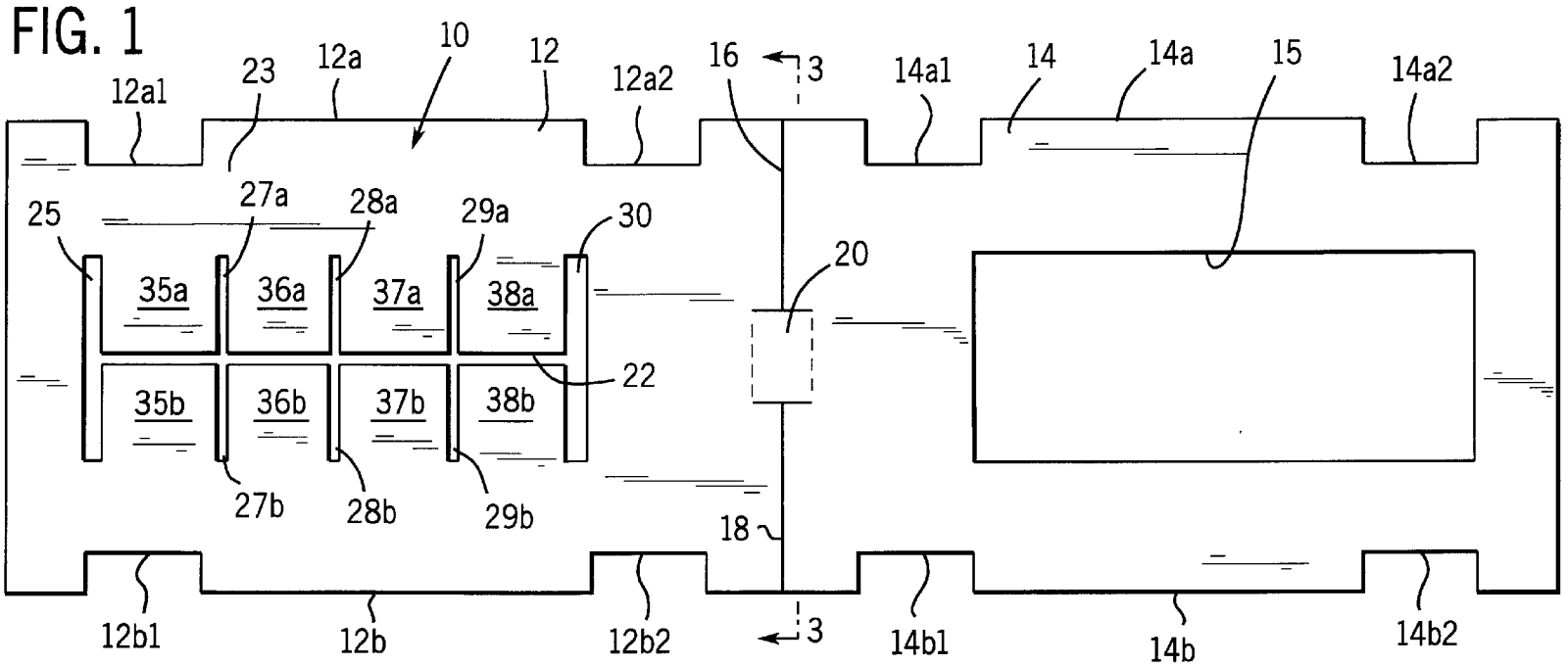
Figure 2:
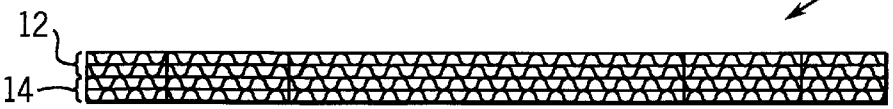
FIG. 2 is a side elevational view of FIG. 1 with the sheet form folded into overlapping, superimposed relation.
Figure 3:
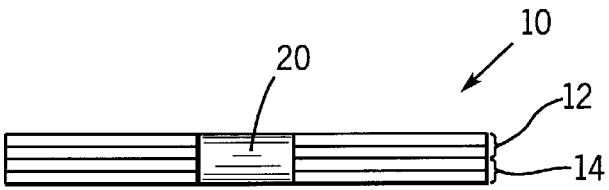
FIG. 3 is an end view taken along line 3—3 of FIG. 1 and after the sheet forms have been arranged in overlapping superimposed relation.

Turning now to the drawings, and especially FIGS. 1–3 therein, a support plate 10 for objects to be packaged and containerized for shipment, constructed in accordance with the present invention, is illustrated therein. The support plate 10 is shown in an unfolded relationship and is comprised of an upper sheet form 12 and lower sheet form 14, preferably formed of a single piece slit along lines 16 and 18 leaving a portion 20 (with slits 16*a* and 18*a* spanning the slit lines into the sheet forms 12 and 14) to act as a hinge so that when the lower support sheet form is folded beneath the upper sheet 12 of the sheet form, the upper and lower support sheet forms are arranged in superimposed overlapping relation to form the support plate 10 (see FIGS. 2 and 3).

While the sheet form may be composed of any of a number of materials and construction, for example sheet board, paper board and the like, it preferably is composed of a heavy cardboard such as double walled, die cut cardboard of approximately 275 pound weight. Moreover, as will be seen relative to FIG. 14, still other sheet form material may be employed for special situations. At this point in the description, however, it should be noted that the support plate of FIGS. 1–3 are for lighter and smaller motors wherein the plate may be formed of an upper and lower sheet formed folded along slits 16 and 18 so that there is a single upper and lower support plate.

Turning once again to FIG. 1, a longitudinally extending separation 22 is provided through the upper sheet form support 12. A plurality of separations, 25, 27*a*, 27*b*; 28*a*, 28*b*; 29*a*, 29*b* and 30 extend from opposite edges 23*a* and 23*b* of the longitudinal separation 22 to form cantilevered tabs or fingers 35*a*, 35*b*; 36*a*, 36*b*; 37*a*, 37*b*; 38*a*, 38*b* in the upper sheet form support 12.

The lower sheet form support 14 is provided with a recess or hole 15 adapted to underlie the longitudinally extending separation 22 to permit deflection of the tabs into the recess 15 when an object is placed on the cantilevered tabs. By spacing the end separations 25 and 30 a distance at least equal to the length of the object (e.g. motor) to be supported by the cantilevered tabs or fingers, the tabs may be deflected into the recess when an object is placed thereon while the end slots or separations 25, 30 enable the structure to partially capture, cradle and cushion the object on the support plate 10.

For purposes which will become more evident hereinafter, at least the longitudinal edges of one of the support plates, in the illustrated instance both edges 12*a* and 12*b* of the upper support plate 12 and the edges 14*a*, 14*b* of the lower support plate 14 are provided with recesses 12*a*1, 12*a*2 , 12*b*1, 12*b*2 in the upper support plate 12 and 14*a*1, 14*a*2, 14*b*1 and 14*b*2 in the lower sheet form support 14. The recesses, in conjunction with their corresponding and adjacent edge portions, form step like recesses and projections.

Figure 6:
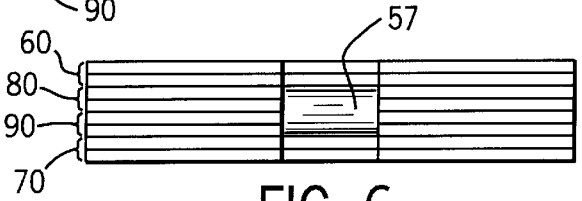
FIG. 6 is an end view of the support plate of FIG. 5.
Figure 5:
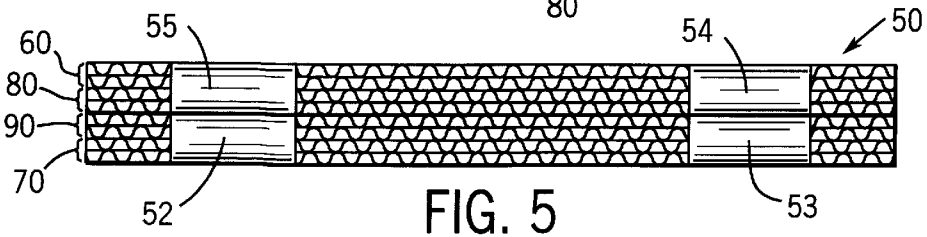
FIG. 5 illustrates a side elevational view of the sheet form of FIG. 5 after it has been folded first along a horizontal axis in FIG. 4, and then vertically to form a four quadrant or layer support base or base plate constructed in accordance with the present invention.

For heavier motors or objects a support plate 50 is formed from a rectangular sheet of sheet form material, for example paperboard, by folding the sheet form (in the present arrangement) along a horizontal or longitudinally extending, interrupted cutline 51, the cuts forming at 52, 53, 54 and 55 hinges. The paperboard is then folded once vertically as along interrupted cutline 56, the interruptions forming hinges 57 and 58 respectively. When the rectangular sheet of paper board is folded first horizontally and then vertically such as illustrated in FIGS. 5 and 6, four quadrants or supports 60, 70, 80 and 90 are formed and lie in superimposed overlapping relation. Notice that because the first fold line is horizontally along interrupted cut 51, the third quadrant 80 contains the recess 85, and the hinge 57 formed between the quadrants or support sheet 60 and 70 is of necessity larger because it bridges two extra layers, supports sheets or quadrants 80 and 90 between the upper support sheet 50 and the lower support sheet 90. Of course, if the paperboard is folded first vertically, then the recess 85 would be disposed in the second quadrant 70 so as to underlie the tabs, described hereinafter.

In the illustrated instance, the hinge 58 may be removed entirely or may form just a recess to accommodate the upper or surface sheet 61 of the paper board 60 joinder to the lower surface 71 of the lowermost paperboard quadrant 70.

As in the instance of FIGS. 1–3, through the uppermost quadrant or sheet form support 60 is a longitudinally extending separation 62, the separation having a length equal to or greater than a portion of the intended object to be placed in abutting relationship therewith on the base plate. As in FIG. 1, a plurality of separations 63, 64*a*, 64*b*; 65*a*, 65*b*; 66*a*, 66*b*, and 67 extend from opposite edges 61*a*, 61*b* of the longitudinal separation 62 and through the upper sheet 60, form a plurality of cantilevered tabs or fingers 68*a*—68*d* and 69*a*—69*d* respectively. As before, the recess 85 in the quadrant 80 underlying the longitudinally extending separation 62 permits deflection of at least some of the tabs 68A–68D, 69A–69D when the object is placed thereon to allow for partial capture, cushioning and cradling of the object on the support plate 50.

Turning now to FIG. 7, FIG. 7 is a plan view of the support plate illustrated in FIGS. 1–3 with an object such as a motor 100 placed thereon. It is noted that the motor length, along its longitudinal axis (without the motor shaft 102,) rests intermediate the end separations 25 and 30 through the upper support plate 12. In this manner, the underlying portion of the motor 100, which is curved or cylindrical in and along its longitudinal axis, depresses and causes deflection of the tabs or fingers. 35*a*–38*a* and 35*b*—38*b* into the recess 15. This deflection of the tabs is illustrated best in FIG. 8 in which an exaggerated and (not to scale) view of the deflection emphasizes the deflection of the cantilevered tabs into the recess 15.

A number of retainers may be employed for capturing or insuring retention of the base plate to the motor or object 100. For example straps or soft wraps may be employed between, in a criss-cross fashion through notch or recess 12*a*1 across the motor 100 to recess 12*b* and tied underneath the base plate. Moreover, and another wrap or strap may be connected around 12*a*2 to 12*b*1, and in a like manner beneath the base plate. However, for gentle but firm retention of the motor 100 against the plate 10, a shrink wrap such as that shown at 110 circumscribing both the plate 10 and the motor 100 is to be preferred. Because of the recesses or notches 12*a*1–12*b*2, even with a loss of memory in the shrink wrap material, it will act as a protective covering for the motor from minor abrasions and the like and will facilitate retaining the motor relative to the base plate 10 to inhibit sliding or longitudinal and lateral motion thereof.

Figure 4:
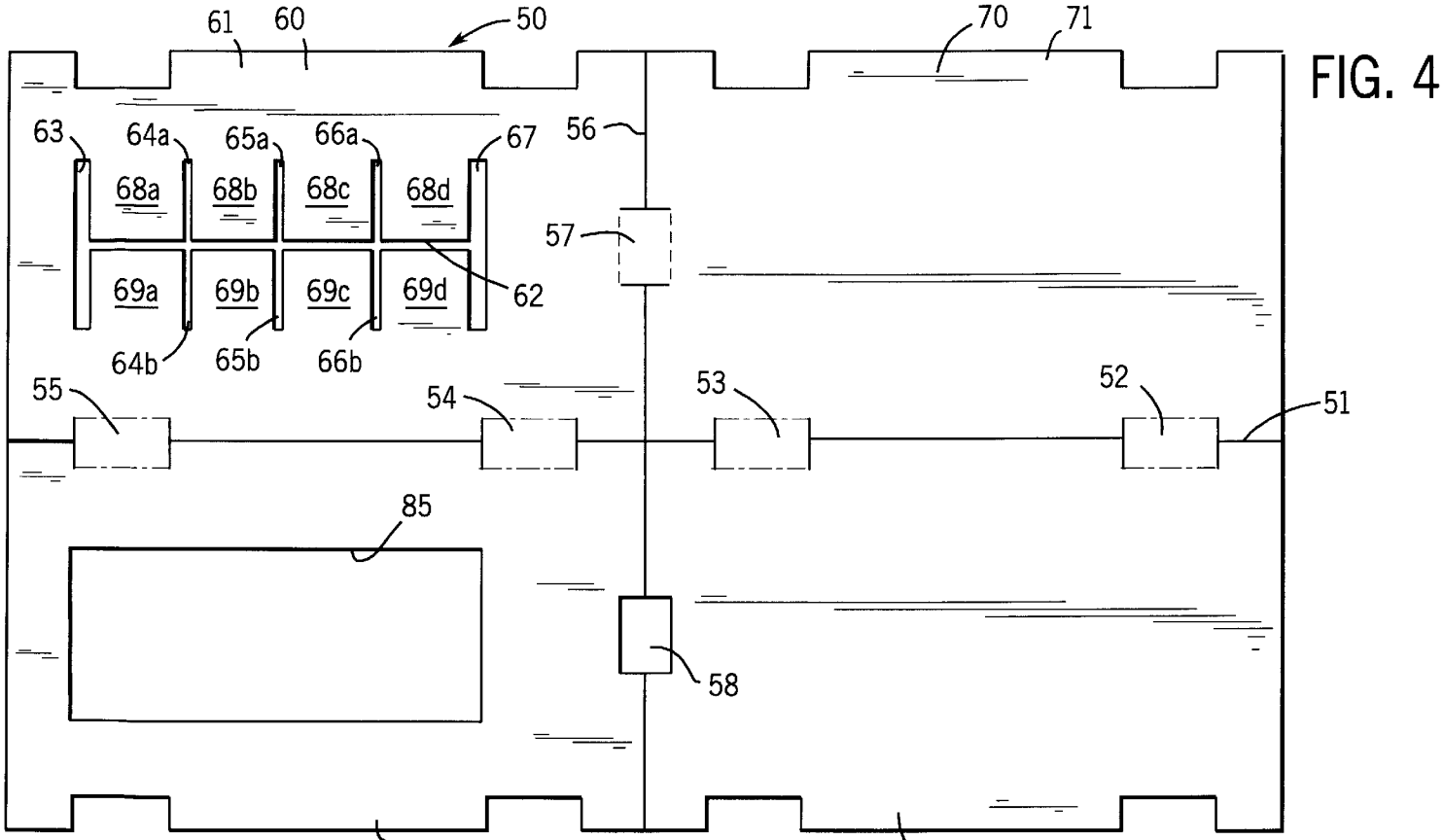
FIG. 4 is a view similar to FIG. 1 except the sheet form is shown as employing four quadrants to provide, when folded, a multiple ply or multiple quadrant support base plate for a package for supporting heavier objects than the design illustrated in FIGS. 1–3.
Figure 11:
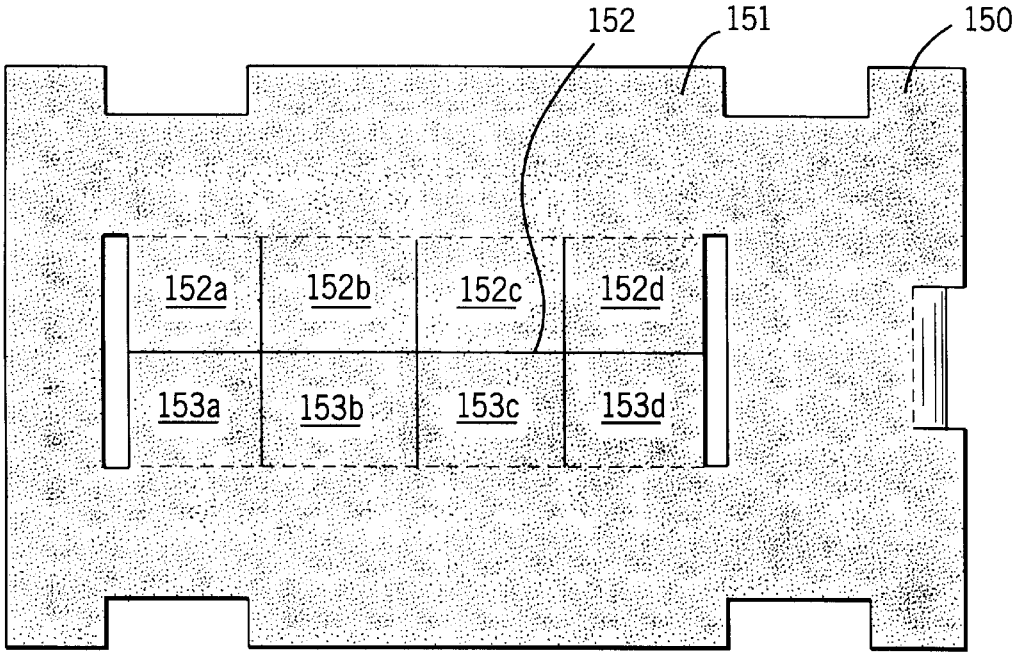
FIG. 11 is a view in plan of a different construction of a top sheet of the base plate sheet form and cantilevered tabs thereon.
Figure 12:
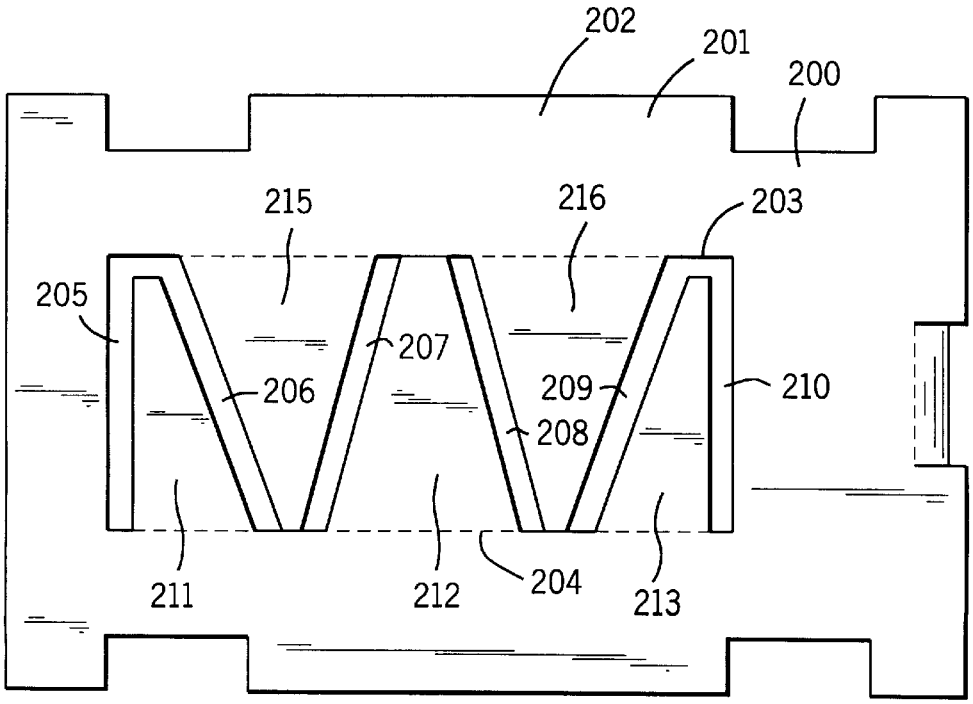
FIG. 12 is a view in plan similar to FIG. 11 except the cantilevered tabs are shown with a different shape to help increase the amount of material depressed into the underlying recess for aiding in support and cushioning of the object.

It should be recognized the tabs may take many forms. For example, in FIG. 11, a base plate 150 similar to that heretofore described is shown with a slit or slot 152 forming the separation in the exposed surface of the sheet form which is exposed surface 151 of the sheet form. The tabs 152*a*–152*d* and 153*a*–153*d* are similar to those formed in FIGS. 1 and 4.

To effect increased cushioning support, it is desirable to have the tabs interlaced, the longitudinal extending separation in the exposed surface 201 of a upper support sheet 202 for formation of a base plate 200 is commensurate with the areas between edges 203 and 204 and includes a plurality of separations 205, 206, 207, 208, 209 and 210 extending from opposite sides 203 and 204 of the separation and interdigitated to form tabs 211, 215, 212, 216 and 213 which are generally triangular in form and tapered from their retentive bases intermediate edges 203 and 204. Thus the tabs 211, 212 and 213 are cantilevered from the edge 204 of the longitudinally extending separation, while tabs 215, and tab 216 are cantilevered from the edge 203 of the longitudinal extending separation. Once again, the remaining part of the base plate or upper sheet of the base plate may be similar to that which is heretofore been described relative to FIGS. 1–6.

Figure 13:
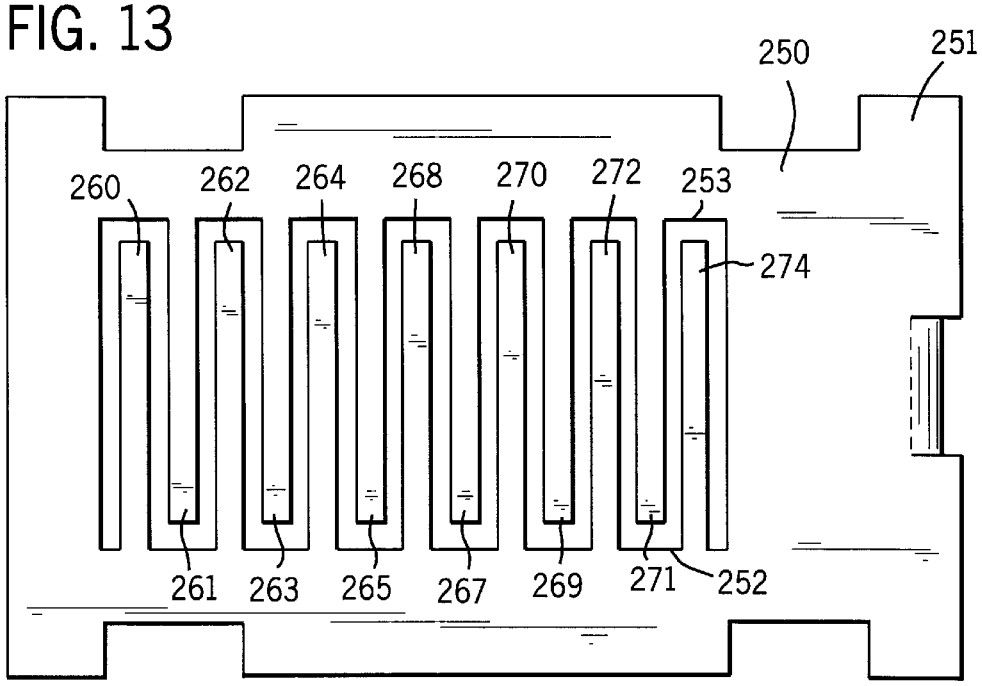
FIG. 13 is a plan view of still another embodiment of the cantilevered tabs in the upper sheet form of the base plate.

In FIG. 13 is yet another form which the cantilevered tabs may take. For example, in FIG. 13 a support plate or base plate 250 is formed of a multiplicity of fingerlike tabs 260, 262, 264, 268, 270, 272, 274 cantilevered from edge 252 of the longitudinally extending separation through the exposed surface of the sheet formed supports 251. Alternatively, extending from the opposite edge 253 of the longitudinally extending separation are fingerlike tabs 261, 263, 265, 267, 269, 271 which are interdigitated with respect to the corresponding tabs cantilevered from the edge 252.

Figure 14:
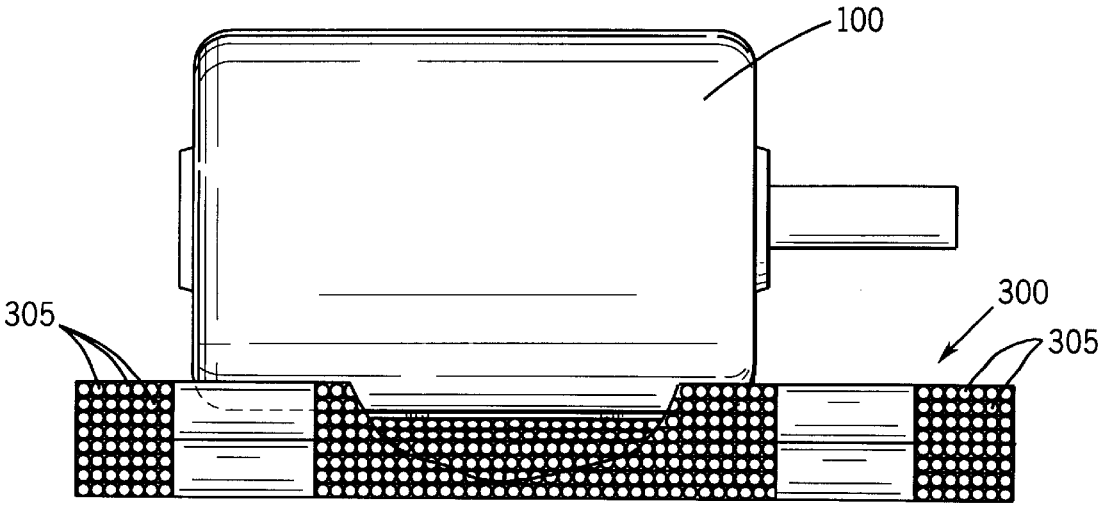
FIG. 14 is a side elevational view of a sheet form constructed as in FIG. 4 and viewed as in FIG. 5 except with the use of a material such as polypropylene and the like with cushioning resilient tubes intermediate the walls to help support, cushion and capture, in the upper sheet of the sheet form, an object such as a motor.

The sheet form support may be composed of other materials arranged as heretofore described. For example, and referring now to FIG. 14, a base plate 300 comprised of polyethylene sheets and including either corrugated or tubular like fill 305 therein form a well cushioned and more resilient structure than is provided with a corrugated fill employed in cardboard and the like, such as illustrated in FIGS. 2 and 5. This would be especially true for large motors in which the base plate was meant to be reused and the tabs would have sufficient resiliency to move back to their preformed position when an object has been removed therefrom. FIG. 14 displays the base plate 300 formed in a similar manner to the base plate 50 illustrated in FIGS. 4–6, with an object such as a motor 100 positioned on the plate.

Figure 15:
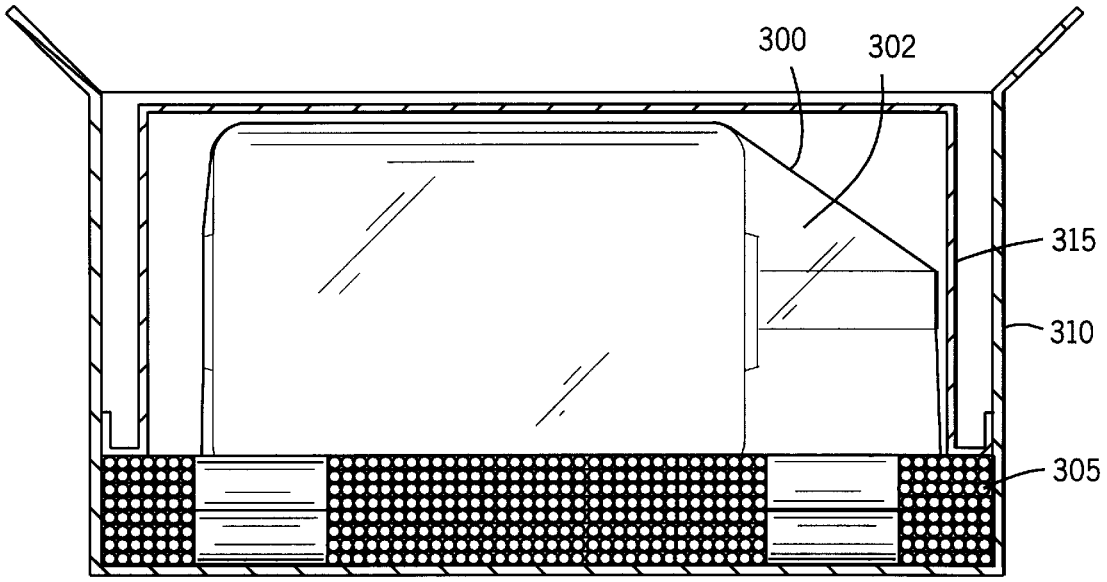
FIG. 15 is a fragmentary side elevational view of the base plate and motor in a shipping container for shipment to a customer.

FIG. 15 illustrates a motor 300 wrapped in a shrink film 302 to couple it to a base plate 305 constructed in accordance with the present invention, and fitted inside a shipping container 310. It is noticed that the base plate fits within the container in such a manner that with its wrapping of shrink wrap 302 it is secure from horizontal displacement, and has been sized in such a manner that the motor shaft, for example, will not poke a hole through the end walls of the container or itself be damaged because it lies within the confines of the base plate. Optionally, to cover the motor and prevent its falling. If the container is accidentally inverted during shipment, a bridge 315 may be employed, the legs of which engage the base plate, and having a height sufficient to be supported by the lid of the shipping container 310.

As it will be understood by those skilled in the art, in certain instances where it is desirable or necessary to prevent abrasion of the surface of the object being supported by the base plate (e.g. a motor) which has been recently painted or otherwise treated, it may be necessary to coat the upper surface of the base plate with a material which inhibits such abrasion to this and, for example, the polyethylene heretofore mentioned would inhibit such abrasion, similarly, coating the paperboard or cardboard with a substance which is smooth and will not abrade the surface of the object being supported, is easily implemented during the processing steps.

It should be recognized that the present invention may be formed in a number of ways but the preferable way for manufacturing the base plate is to arrange a pair of sheets of sheet form in superimposed overlapping relation, the sheets being sized larger than the size of the object intended to be supported by the support plate and then generating a plurality of cantilevered tabs extending inwardly in the exposed surface of one of the sheets while forming a recess in the sheet of sheet form underlying the cantilevered tabs for permitting deflection of at least some of the tabs to conform to the shape of the object when the object is placed thereon. In this matter the object is partially captured and cradled as well as cushioned on and in the plate. Thereafter, to form the package, the object may be secured to the plate as by shrink wrap or other available means and then secured interiorly of a shipping container for ultimate shipment.

While the invention has been described with a certain degree of particularity, changes in the method of operation and structure may easily be imagined and incorporated by those skilled in the art. These and other subject matter are intended to be covered by the claims appended hereto.

What is claimed is:

1. A support plate to inhibit an object from inadvertent displacement when the plate and object are positioned within a shipping container; said plate comprising, an upper and lower sheet form support arranged in superimposed, overlapping relation to form a support plate;

a longitudinally extending separation in an exposed surface of the upper of said sheet form supports, said separation having inwardly facing opposing edges;

a plurality of separations extending from said opposing edges of said longitudinal separation to form inwardly extending cantilevered tabs on opposite sides of said longitudinally extending separation, a recess formed in the lower sheet form support underlying said longitudinally extending separation for permitting deflection of said tabs into said recess when an object is placed on a plurality of said tabs over said recess, to thereby partially capture, cradle and cushion the object on said support plate, wherein the tabs include at least first and second tabs extending inwardly from opposing sides of the upper sheet form support.

2. A support plate in accordance with claim 1 wherein said support plate comprises a sheet of paperboard folded at least once to form said upper and lower supports.

3. A support plate in accordance with claim 1 including a plurality of cantilevered, interdigitated tabs on opposite sides of said separation, said tabs overlying said recess in the lower sheet form support.

4. A support plate in accordance with claim 2 wherein said longitudinal separation has a length equal to or greater than the intended object to be placed in said package, but less than the length of said upper sheet form support.

5. A support plate in accordance with claim 4 including recesses along at least one peripheral edge of one of said supports to facilitate retention of an object-support plate wrap by a retainer.

6. A package including a support plate to inhibit an object from inadvertent displacement when the package is positioned within a shipping container; said package comprising, a support plate including an upper and lower sheet form support arranged in superimposed, overlapping relation to form said plate;

a longitudinally extending separation in and through an exposed surface of the upper of said sheet form supports, said longitudinal separation having a length equal to or greater than the intended object to be placed in said package, but less than the length of said upper sheet form support, said separation having inwardly facing opposing edges;

a plurality of separations extending from said opposing edges of said longitudinal separation to form inwardly extending cantilevered tabs on opposite sides of said longitudinally extending separation, wherein the tabs include at least first and second tabs extending inwardly from opposing sides of the upper sheet form support;

at least one recess formed in the sheet form support underlying said longitudinally extending separation for permitting deflection thereunto of more than one of said tabs when an object to be packaged is placed on a plurality of said tabs over said recess to thereby partially cradle the object on said support plate, and;

an object and support plate retention means to couple said object and plate together to form a package.

7. A package in accordance with claim 6 wherein said retention means comprises a shrinkwrap material.

8. A package in accordance with claim 7 wherein said plate includes recesses and projections along at least one peripheral edge of said plate to inhibit creeping of said shrinkwrap over time.

9. A package in accordance with claim 6 wherein said support plate comprises a panel of sheet form folded at least once to form to said upper and lower supports.

10. A package in accordance with claim 9 wherein said retention means comprises a shrinkwrap material, and includes recesses and projections along at least one superimposed edge of the peripheral edges of said upper and lower supports to inhibit creeping of said shrinkwrap over time.

11. A package in accordance with claim 6 wherein said support plate comprises a panel of sheet form folded at least once horizontally and once vertically to form four quadrants in superimposed, overlapping relation;

said retention means comprising a shrinkwrap material, including recesses and projections along at least one superimposed edge of the peripheral edges of said quadrants to inhibit creeping of said shrinkwrap over time.

12. A method of forming a package for an object to be placed in a shipping container, said package including a base plate for mounting the object thereon, said method including manufacturing a support plate for the object to be packaged, said manufacturing including:

arranging a pair of rectangular sheets of sheet form in superimposed, overlapping relation, said sheets sized to be larger than the size of said object intended to be supported by said support plate;

generating a longitudinally extending separation in an exposed surface of the upper of said sheet form supports, said separation having inwardly facing opposing edges;

generating a plurality of separations extending from said opposing edges of said longitudinal separation to form a plurality of inwardly extending cantilevered tabs on opposite sides of said longitudinally extending separation, wherein the plurality of tabs includes at least first and second tabs extending inwardly from opposing sides of an upper sheet of the pair of rectangular sheets;

forming a recess in the sheet of sheet form underlying said cantilevered tabs for permitting deflection of at least some of said tabs to conform to the shape of an object when the object is placed on a plurality of said tabs over said recess to thereby partially capture and cradle an object on said plate; and securing an object to said plate to form a package for a shipping container.

* * * * *